US010544944B2

(12) United States Patent
Branecky et al.

(10) Patent No.: US 10,544,944 B2
(45) Date of Patent: Jan. 28, 2020

(54) SYSTEM AND METHOD FOR GRID LOAD-UP DUAL SET POINT

(71) Applicant: A. O. SMITH CORPORATION, Milwaukee, WI (US)

(72) Inventors: Brian T. Branecky, Oconomowoc, WI (US); Yonggon Lee, Brookfield, WI (US)

(73) Assignee: A. O. Smith Corporation, Milwaukee, WI (US)

( * ) Notice: Subject to any disclaimer, the term of this patent is extended or adjusted under 35 U.S.C. 154(b) by 28 days.

(21) Appl. No.: 15/182,219

(22) Filed: Jun. 14, 2016

(65) Prior Publication Data

US 2017/0356660 A1 Dec. 14, 2017

(51) Int. Cl.

| | |
|---|---|
| ***F24D 17/00*** | (2006.01) |
| ***F24H 1/00*** | (2006.01) |
| ***F24H 1/18*** | (2006.01) |
| ***F24H 9/20*** | (2006.01) |

(52) U.S. Cl.

CPC ..... *F24D 17/0026* (2013.01); *F24H 1/0018* (2013.01); *F24H 1/185* (2013.01); *F24H 9/2014* (2013.01)

(58) Field of Classification Search

CPC ..... F24H 9/2014; F24H 1/0018; F24H 1/185
USPC ..... 122/14.3, 14.21, 14.1; 392/447
See application file for complete search history.

(56) References Cited

U.S. PATENT DOCUMENTS

| | | | | |
|---|---|---|---|---|
| 8,761,589 | B2 | 6/2014 | Roetker et al. | |
| 9,124,098 | B2 | 9/2015 | Broniak et al. | |
| 2010/0179705 | A1 | 7/2010 | Flohr | |
| 2010/0209084 | A1* | 8/2010 | Nelson | F24H 4/04 392/465 |
| 2011/0147360 | A1 | 6/2011 | Hammerstrom | |
| 2013/0038122 | A1 | 2/2013 | Broniak et al. | |
| 2013/0200168 | A1 | 8/2013 | Buescher et al. | |
| 2013/0202277 | A1 | 8/2013 | Roetker et al. | |
| 2013/0215122 | A1* | 8/2013 | McCollum | G09G 3/3406 345/501 |
| 2014/0153383 | A1 | 6/2014 | Mabilleau et al. | |
| 2014/0277816 | A1* | 9/2014 | Branecky | G05D 23/1923 700/300 |

* cited by examiner

*Primary Examiner* — Steven B McAllister
*Assistant Examiner* — Benjamin W Johnson
(74) *Attorney, Agent, or Firm* — Michael Best & Friedrich LLP

(57) ABSTRACT

System and method for grid load-up dual set point. The invention provides a method of operating a water heater having a tank configured to store water. The method includes heating, via a first heating element, a first portion of the water to a first temperature set point. The method also includes heating, via a second heating element, a second portion of the water to a second temperature set point, the second temperature set point being greater than the first temperature set point. The method additionally includes receiving a load-up signal from a grid controller, and heating, via the first heating element, the first portion of the water to the second temperature set point upon receiving the load-up signal.

10 Claims, 4 Drawing Sheets

SYSTEM AND METHOD FOR GRID LOAD-UP DUAL SET POINT

BACKGROUND

The present invention generally relates to water heaters.

SUMMARY

Electric water heaters use electrical energy to heat the water located inside a water tank. The electrical energy may come from a power source such as a grid, or power grid, such as but not limited to an energy company power grid or a home power grid including one or more of solar panels, windmills, or other sources. Traditional water heaters receive electrical energy from the power source, as required, to heat the water.

Energy companies may have off-peak hours when electrical energy costs are lower than during on-peak hours. Additionally, a solar panel may receive solar power, and a windmill may receive wind power, at certain times to put positive excess energy on the grid. The present invention adds electrical energy to the water heater during beneficial times (e.g., off-peak hours or when there is positive excess energy on the grid), instead of only when electrical energy is needed, in order to optimize energy usage.

In one embodiment, the invention provides a method of operating a water heater having a tank configured to store water. The method includes heating, via a first heating element, a first portion of the water to a first temperature set point. The method also includes heating, via a second heating element, a second portion of the water to a second temperature set point, the second temperature set point being greater than the first temperature set point. The method additionally includes receiving a load-up signal from a grid controller, and heating, via the first heating element, the first portion of the water to the second temperature set point upon receiving the load-up signal.

In another embodiment the invention provides a water heater. The water heater includes a tank for holding water, a first heating element configured to heat a first portion of the water, a second heating element configured to heat a second portion of the water, and a controller including a processor and a computer readable memory storing instructions. When the instructions are executed by the processor, the instructions cause the controller to activate the first heating element to heat the first portion of the water to a first temperature set point. The instructions also cause the controller to activate the second heating element to heat the second portion of the water to a second temperature set point, the second temperature set point being greater than the first temperature set point. Additionally, the instructions cause the controller to receive a load-up command from an external controller and activate the first heating element to heat the first portion of the water to the second temperature set point upon receiving the load-up command.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawing. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
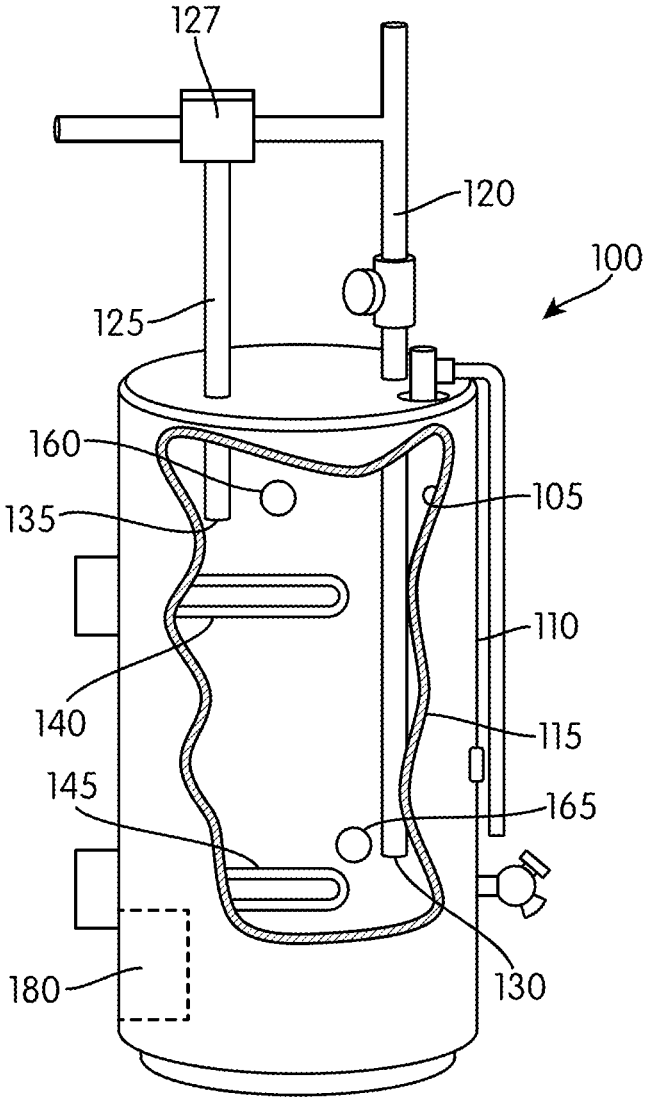
FIG. 1 is a partial exposed view of a water heater according to some embodiments of the invention.

FIG. 1 is a partial exposed view of a storage-type water heater 100 according to some embodiments of the invention. The water heater 100 includes an enclosed water tank 105, a shell 110 surrounding the water tank 105, and foam insulation 115 filling an annular space between the water tank 105 and the shell 110. A typical water tank 105 may be made of ferrous metal and lined internally with a glass-like porcelain enamel to protect the metal from corrosion. In other embodiments, the water tank 105 may be made of other materials, such as plastic.

A water inlet line 120 and a water outlet line 125 may be in fluid communication with the water tank 105 at a top portion of the water heater 100. The inlet line 120 may have an inlet opening 130 for adding cold water to the water tank 105, and the outlet line 125 may have an outlet opening 135 for withdrawing hot water from the water tank 105. The inlet line 120 and the outlet line 125 may be in fluid communication with a mixing valve 127. The mixing valve 127 may combine water from both the inlet line 120 and the outlet line 125 in order to output water at a delivery temperature set point. In some embodiments, the mixing valve 127 may include electrical and electronic components configured to set the delivery temperature set point. For example, but not limited to, a controller and a sensor (e.g., a water temperature sensor).

The water heater 100 may also include an upper heating element 140 and a lower heating element 145 that may be attached to the water tank 105 and may extend into the water tank 105 to heat the water. Each heating element 140, 145 may be an electric resistance heating element or another type of heating element. In some embodiments, the upper heating element 140 may heat an upper portion (e.g., the upper one-third) of the water in the water tank 105 and the lower heating element 145 may heat a lower portion (e.g., the lower two-thirds) of the water in the water tank 105. Although in the illustrated embodiment, two heating elements 140, 145 are shown, any number of heating elements may be included in the water heater 100. The invention may also be used with other fluid-heating apparatus for heating a conductive fluid, such as an instantaneous water heater or an oil heater, and with other heater element designs and arrangements.

The water heater 100 may also include temperature sensors 160 and 165. In some embodiments, the water heater 100 may include more or less temperature sensors. In the illustrated embodiment, temperature sensor 160 is an upper temperature sensor and temperature sensor 165 is a lower temperature sensor. Additionally, in some embodiments, temperature sensor 160 is positioned proximate the upper heating element 140 and temperature sensor 165 is positioned proximate lower heating element 145. The temperature sensors 160, 165 may be in contact with the water tank 105 walls, and may be, for example, thermistor-type sensors. In the embodiment shown, temperature sensors 160, 165 may be used to control the upper and lower heating elements 140, 145. In some embodiments, temperature sensor 160 monitors the upper portion of the water in the water tank 105 and a control system 180 may activate the upper heating element 140 based on data from the temperature sensor 160. Additionally, temperature sensor 165 may monitor the lower portion of the water in the water tank 105 and the control system 180 may activate the lower heating element 145 based on data from the temperature sensor 165.

The water heater 100 may also include the control system 180. The control system 180 may be attached to the water heater 100 (e.g., within, outside of, or on top of the shell 110), located remotely from the water heater 100, or a combination thereof. The control system 180 may be one system or numerous systems working together. The control system 180 may be communicatively coupled to components of the water heater 100 and a network and will later be described in greater detail.

Figure 2:
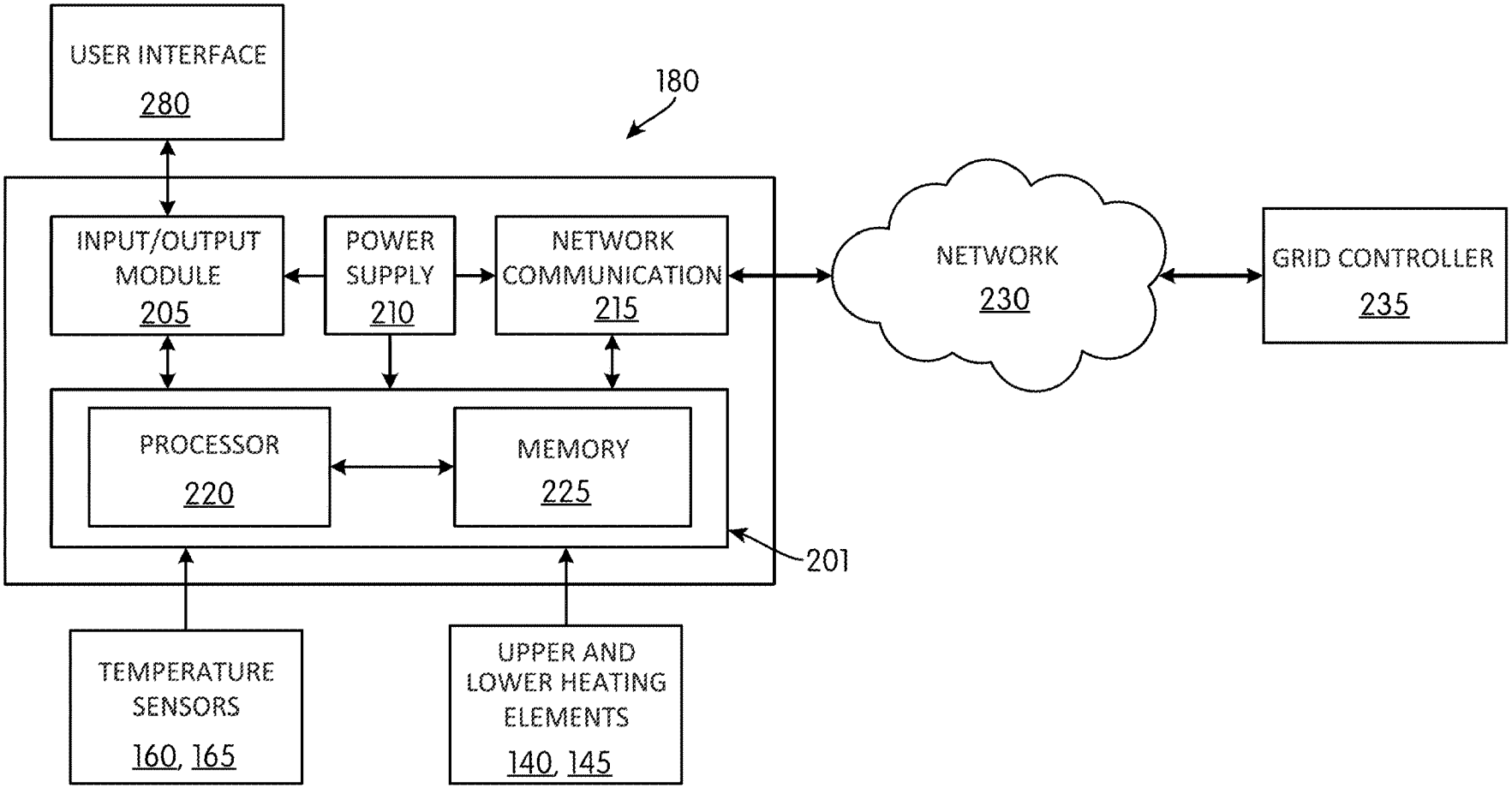
FIG. 2 illustrates a control system associated with the water heater of FIG. 1 according to some embodiments of the invention.

FIG. 2 illustrates a block diagram of the control system 180 associated with the water heater 100 of FIG. 1 according to some embodiments of the invention. The control system 180 may be electrically and/or communicatively coupled to a variety of modules or components associated with the water heater 100. The control system 180 includes combinations of hardware and software that are operable to, among other things, control the operation of the water heater 100. For example, the control system 180 may include an input/output module 205, a power supply 210, a network communication 215, and a controller 201. The modules and components within the control system 180 may be connected by one or more control and/or data buses (e.g., a common bus). The control and/or data buses are shown generally in FIG. 2 for illustrative purposes. The use of one or more control and/or data buses for the interconnection between and communication among the various modules and components would be known to a person skilled in the art in view of the invention described herein.

The controller 201 may include a processor 220 and a memory 225. The controller 201 may be electrically and/or communicatively coupled to the input/output module 205, the power supply 210, and the network communication 215. The processor 220 may be a microprocessor, a microcontroller, or another suitable programmable device. The processor 220 may include among other things, a control unit, an arithmetic logic unit ("ALU"), and a plurality of registers, and may be implemented using a known computer architecture, such as a modified Harvard architecture, a von Neumann architecture, etc.

The memory 225 includes, for example, a program storage area and a data storage area. The program storage area and the data storage area may include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processor 220 may be connected to the memory 225 and may execute software instructions that may be capable of being stored in a RAM of the memory 225 (e.g., during execution), a ROM of the memory 225 (e.g., on a generally permanent basis), or another non-transitory computer readable medium such as another memory or a disc. Software included in the implementation of the water heater 100 may be stored in the memory 225 of the controller 201. The software includes, for example, firmware, one or more applications, program data, filters, rules, one or more program modules, and other executable instructions. The controller 201 may be configured to retrieve from memory 225 and execute, among other things, instructions related to the control processes and methods described herein. In other constructions, the controller 201 includes additional, fewer, or different components.

The controller 201 may further be communicatively coupled to the temperature sensors 160, 165 and the upper and lower heating elements 140, 145. The controller 201 may store information regarding the temperatures sensed by the temperature sensors 160, 165 in the memory 225. The processor 220 may execute instructions to control the upper and lower heating elements 140, 145. In some embodiments, the controller 201 may be coupled to other components of the water heater 100, such as the mixing valve 127. In such an embodiment, the controller 201 may be communicatively coupled with the controller and the sensor of the mixing valve 127. In such an embodiment, the controller 201 may communicate with the mixing valve 127 to set the delivery temperature set point.

The input/output module 205 transmits data from the control system 180 to external devices located remotely or connected to the water heater 100 (e.g., over one or more wired and/or wireless connections). The input/output module 205 may provide received data to the controller 201. The input/output module 205 may also include a port (e.g., an RS232 port) for wired communication with an external device.

The user interface 280 may be communicatively coupled to the input/output module 205 and may be used to control and/or monitor the water heater 100. For example, the user interface 280 may be operably coupled to the control system 180 to control temperature settings of the water heater 100. For example, using the user interface 280, a user may set one or more temperature set points for the water heater 100.

The user interface 280 may include a combination of digital and analog input or output devices required to achieve a desired level of control and monitoring for the water heater 100. For example, the user interface 280 may include a display (e.g., a primary display, a secondary display, etc.) and an input device (e.g., a touch-screen display, a plurality of knobs, dials, switches, buttons, etc.). The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface 280 may also be configured to display conditions or data associated with the water heater 100 in real-time or substantially real-time. For example, but not limited to, the user interface 280 may be configured to display measured electrical characteristics of the upper heating element 140 and lower heating element 145, the temperature sensed by temperature sensors 160, 165, an average temperature of the water, etc. In some implementations, the user interface 280 may be controlled in conjunction with the one or more indicators (e.g., LEDs, speakers, etc.) to provide visual or auditory indications of the status or conditions of the water heater 100. In some embodiments, the user interface 280 may also include a "power on" indicator and an indicator for each heating element 140, 145 to indicate whether the element is active.

The user interface 280 may operate on utility power, but may also include a battery backup power source for program retention in the event of a power failure. The user interface 280 may be mounted on the shell 110, remotely from the water heater 100 in the same room (e.g., on a wall), in another room in the building, or even outside of the building. The interface between the control system 180 and the user interface 280 may include a 2-wire bus system, a 4-wire bus system, or a wireless signal.

The power supply 210 may be electrically and/or communicatively coupled to the input/output module 205, the controller 201, and the network communication 215. The power supply 210 may supply a nominal AC or DC voltage to the control system 180. The power supply 210 may be powered by, for example, a 110 volt, 240 volt, or 480 volt power supply. The power supply 210 may also be configured to supply lower voltages to operate circuits and components within the control system 180 or water heater 100.

The network communication 215 may be communicatively coupled to the power supply 210, the controller 201, and the network 230. The network communication 215 may send data from the control system 180 to the network 230. The network communication 215 may also receive data from the network 230, such as a load-up event signal. The network communication 215 may have a wired (e.g., a USB connection) and/or a wireless connection for communication with the network 230. In some embodiments, the network communication 215 may use a CTA-2045 standard.

In some embodiments, the network 230 is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network 230 is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network 230 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections between the control system 180, an external, or grid, controller 235 and the network 230 may be, for example, wired connections, wireless connections, or a combination of wireless and wired connections. In some embodiments, the control system 180 or grid controller 235 may include one or more communications ports (e.g., Ethernet, serial advanced technology attachment ["SATA"], universal serial bus ["USB"], integrated drive electronics ["IDE"], etc.) for transferring, receiving, or storing data associated with the water heater 100 or the operation of the water heater 100.

The grid controller 235 may be communicatively coupled to the network 230. The grid controller 235 monitors the grid from which the water heater 100 may receive electrical energy. If the grid controller 235 detects a beneficial state of the grid, then the grid controller 235 may send a load-up signal to the network 230. A beneficial state may be for example, when the grid does not have a high demand and is operating in an off-peak time. A beneficial state may also be, for example, when a solar panel or windmill is producing positive excess electrical energy. The load-up signal may be sent from the network 230 to the control system 180. The controller 201 may send a signal to the lower heating element 145 to heat the water in order to optimize energy as will be explained later in greater detail. In some embodiments, the grid controller 235 is operated by the utility. In other embodiments, the grid controller 235 is operated by a third-party. In such an embodiment, the third-party may be a third-party aggregator. In such an embodiment, the third-party aggregator monitors the grid independently of the utility and sends the load-up signal to the water heater 100 based on such monitoring. In yet other embodiments, the grid controller 235 is a residential grid controller. In such an embodiment, the grid controller 235 may be configured to monitor a home power grid.

Figure 3:
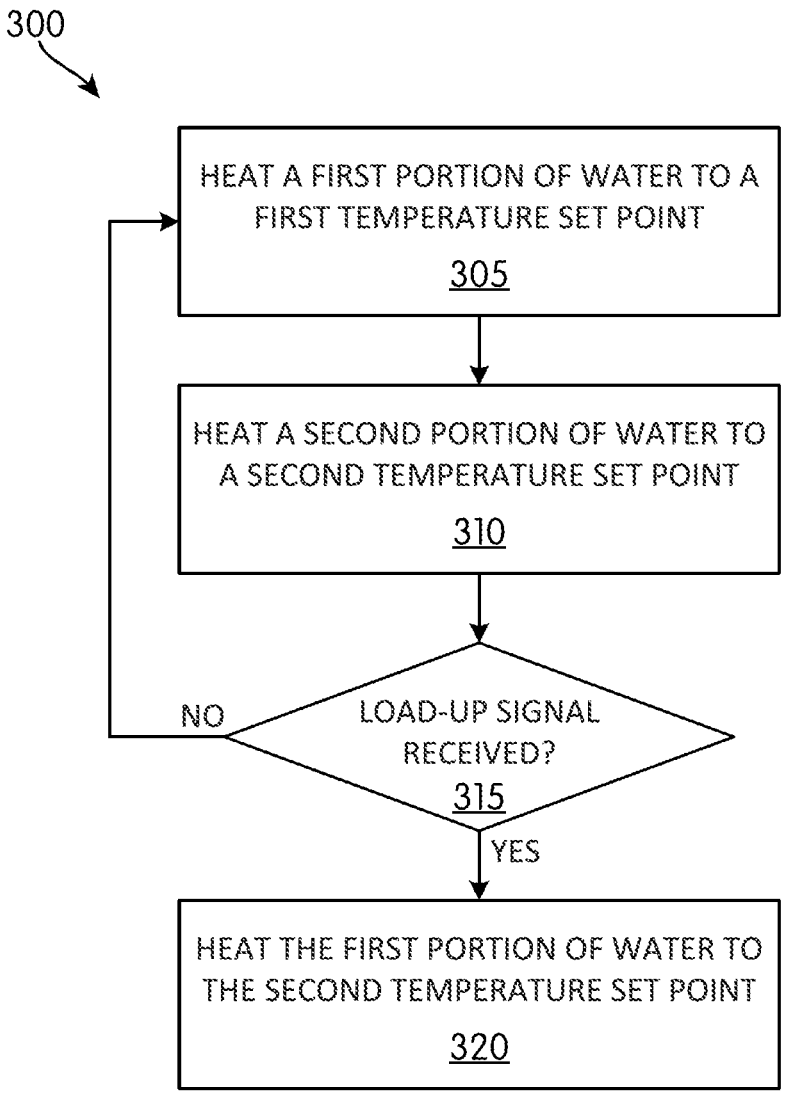
FIG. 3 is a flow chart of an operation of the water heater of FIG. 1 according to some embodiments of the invention.
Figure 4:
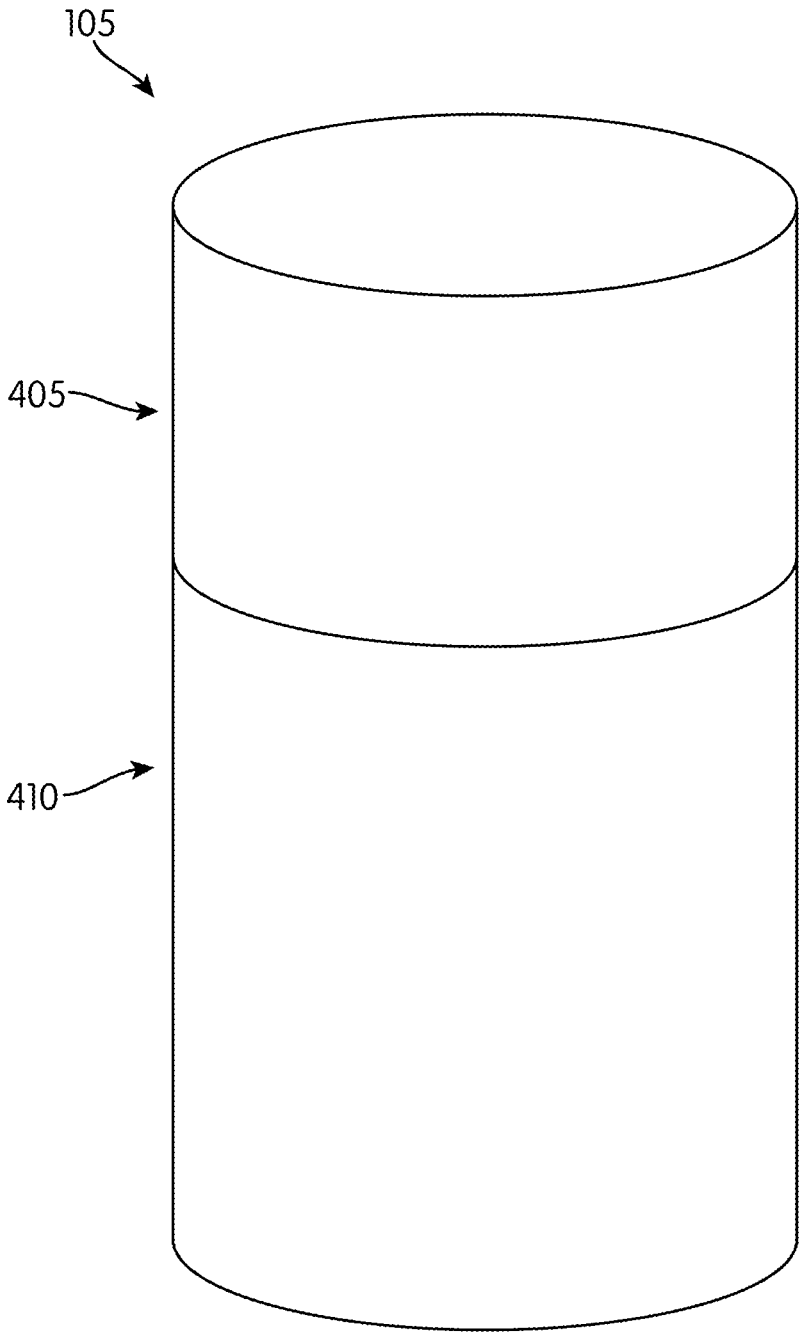
FIG. 4 illustrates a first portion and a second portion of the water tank of FIG. 1 according to some embodiments of the invention.

FIG. 3 is a flow chart of an operation, or process, 300 of the water heater 100 according to some embodiments of the invention. It should be understood that the order of the steps disclosed in process 300 could vary. Furthermore, additional steps may be added to the control sequence and not all of the steps may be required. At step 305, first portion 410 of water is heated to a first temperature set point. Referring to FIG. 4, the first portion 410 of water may be the lower two-thirds of water within the water tank 105. In such an embodiment, the first portion 410 of water may be heated using the lower heating element 145. Referring back to FIG. 3, at step 310, a second portion 405 of water is heated to a second temperature set point. In some embodiments, the second temperature set point is above the first temperature set point. Referring back to FIG. 4, the second portion 405 of water may be the upper one-third of water within the water tank 105. In such an embodiment, the second portion 405 of water may be heated using the upper heating element 140. At step 315, the control system 180 determines if a load-up signal has been received from the grid controller 235. As previously discussed, the grid controller 235 sends a load-up signal when the grid is operating at a beneficial state such as, for example, when the grid does not have a high demand and is operating in an off-peak time. Additionally, a beneficial state may also be, for example, when a solar panel or windmill is producing positive excess electrical energy. When the grid controller 235 detects the beneficial state, which may be based on a threshold, the grid controller 235 may send a load-up signal to the network 230 which then may send a load-up signal to the control system 180 (via the network communication 215). When the load-up signal is received, the process 300 moves to step 320, where the first portion 410 of water is heated to the second temperature set point. As discussed above, the first portion 410 of water may be heated using the lower heating element 145. When a load-up signal is not received at step 315, the process 300 loops back to step 305 where the first portion 410 of water is heated to the first temperature set point. Water contained within the water tank 105 may then be output to the mixing valve 127. In some embodiments, the process 300 may further include outputting water from the mixing valve 127, to the user, at a delivery temperature set point. In some embodiments, the delivery temperature set point is substantially equal to the first temperature set point.

In some embodiments of the invention, the delivery temperature set point may be set for the water that is output from the mixing valve 127. In such an embodiment, the delivery temperature set point may be set using the user interface 280 or any other method discussed above. In some embodiments, the delivery temperature set point may be the same as the first temperature set point. As discussed above, in some embodiments, the mixing valve 127 may include a temperature sensor. In such an embodiment, the temperature sensor may be communicatively coupled to the control system 180.

By using this method, the amount of electrical energy added to the water heater 100 is increased during a load-up event. Increasing the electrical energy added during a load-up event, opposed to adding electrical energy only when the water heater 100 requires additional energy, optimizes energy usage by storing electrical energy when it is beneficial.

Thus, the invention provides, among other things, a system and method for a dual set point load-up of a water heater. The constructions of the water heater and the methods of operating the water heater described above and illustrated in the figure are presented by way of example only and are not intended as a limitation upon the concepts and principles of the invention. Various features and advantages of the invention are set forth in the following claims.

What is claimed is:

1. A method of operating a water heater having a tank configured to store water in the tank, the method comprising:

heating, via a first heating element, a first portion of the water to a first temperature set point, the first portion of water being a lower two-thirds of the water [in] the tank;

heating, via a second heating element, a second portion of the water to a second temperature set point, the second temperature set point being greater than the first temperature set point, the second portion of water being an upper one-third of the water [in] the tank;

receiving a load-up command from an external controller; and heating, via the first heating element, the first portion of the water to the second temperature set point while heating, via the second heating element, the second portion of water to the second temperature set point in response to receiving the load-up command.

2. The method of claim 1, further comprising outputting, via a mixing valve, the water at a third temperature set point, the third temperature set point being less than the second temperature set point.

3. The method of claim 1, further comprising outputting, via a mixing valve, the water at a third temperature set point, the third temperature set point being set by a user.

4. The method of claim 1, wherein the load-up command results from excess energy from at least one of wind energy or solar energy.

5. The method of claim 1, wherein the external controller is at least one of a grid controller or an aggregator controller.

6. A water heater comprising:

a tank that holds water in the tank;

a first heating element configured to heat a first portion of water in the tank, the first portion of water being a lower two-thirds of the water [in] the tank:

a second heating element configured to heat a second portion of water in the tank, the second portion of water being an upper one-third of the water [in] the tank; and a controller including a processor and a computer readable memory storing instructions that, when executed by the processor, cause the controller to:

activate the first heating element to heat the first portion of water to a first temperature set point;

activate the second heating element to heat the second portion of water to a second temperature set point, the second temperature set point being greater than the first temperature set point;

receive a load-up command from an external controller if a load-up command is available; and activate the first heating element to heat the first portion of water to the second temperature set point and activate the second heating element to heat the second portion of water to the second temperature set point in response to receiving the load-up command.

7. The water heater of claim 6, further comprising a mixing valve that outputs the water at a third temperature set point, the third temperature set point being less than the second temperature set point.

8. The water heater of claim 6, further comprising a mixing valve that outputs the water at a third temperature set point, the third temperature set point being set by a user.

9. The water heater of claim 6, wherein the load-up command results from excess energy from at least one of wind energy or solar energy.

10. The water heater of claim 6, wherein the external controller is at least one of a grid controller or an aggregator controller.

* * * * *